US006789682B2

(12) United States Patent
Minamishin et al.

(10) Patent No.: US 6,789,682 B2
(45) Date of Patent: Sep. 14, 2004

(54) PAPER PROCESSING APPARATUS INCLUDING PAYMENT UNIT EQUIPPED FOR SELECTIVE USE WITH ALTERNATIVE DETACHABLY CONNECTED RECEPTION UNITS

(75) Inventors: Hayato Minamishin, Kawasaki (JP); Atsunori Kimura, Kawasaki (JP); Hayami Abe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 190 days.

(21) Appl. No.: 10/026,450

(22) Filed: Dec. 27, 2001

(65) Prior Publication Data

US 2003/0047861 A1 Mar. 13, 2003

(30) Foreign Application Priority Data

Sep. 11, 2001 (JP) ..... 2001-274672

(51) Int. Cl.[7] ..... B65H 35/02

(52) U.S. Cl. ..... 209/534; 271/3.03; 271/301

(58) Field of Search ..... 209/534; 271/3.03, 271/301

(56) References Cited

U.S. PATENT DOCUMENTS

| | | | | | |
|---|---|---|---|---|---|
| 4,616,817 | A | * | 10/1986 | Yamauchi et al. | 271/111 |
| 4,625,870 | A | * | 12/1986 | Nao et al. | 209/534 |
| 4,726,474 | A | * | 2/1988 | Arikawa et al. | 209/534 |
| 4,854,452 | A | * | 8/1989 | Uchida et al. | 209/534 |
| 5,000,322 | A | * | 3/1991 | Goi | 209/534 |
| 5,199,697 | A | * | 4/1993 | Yamada et al. | 271/122 |
| 5,739,509 | A | * | 4/1998 | Watanabe | 235/379 |
| 6,254,083 | B1 | * | 7/2001 | Abe et al. | 271/114 |
| 6,315,279 | B1 | * | 11/2001 | Minamishin et al. | 271/3.15 |
| 6,331,000 | B1 | * | 12/2001 | Beskitt et al. | 271/3.01 |
| 6,533,261 | B2 | * | 3/2003 | Katou et al. | 271/3.12 |
| 6,607,081 | B2 | * | 8/2003 | Graef et al. | 209/534 |
| 2004/0079683 | A1 | * | 4/2004 | Utz et al. | 209/534 |

FOREIGN PATENT DOCUMENTS

| | | |
|---|---|---|
| JP | 5-159136 | 6/1993 |
| JP | 8-221637 | 8/1996 |
| JP | 2790423 | 6/1998 |
| JP | 3031193 | 2/2000 |
| JP | 2000-200379 | 7/2000 |

* cited by examiner

*Primary Examiner*—Donald P. Walsh
*Assistant Examiner*—Daniel K Schlak
(74) *Attorney, Agent, or Firm*—Armstrong, Kratz, Quintos, Hanson & Brooks, LLP

(57) ABSTRACT

A paper processing apparatus feeds papers one by one from the first cassette for storing papers to be delivered to the outside, conveys the fed papers on the first conveyance path to store them in a predetermined temporary storing section, and then delivers the stored papers in a block through a paper delivery aperture to the outside. Also, the paper processing apparatus leads papers having difficulties with delivery after being fed from the first cassette, to the second conveyance path which is a divergent path of the first conveyance path, and stores the led papers in the second cassette. The paper processing apparatus further comprises the third conveyance path for receiving papers coming from the outside and transmitting them to the first conveyance path.

12 Claims, 14 Drawing Sheets

PAPER PROCESSING APPARATUS INCLUDING PAYMENT UNIT EQUIPPED FOR SELECTIVE USE WITH ALTERNATIVE DETACHABLY CONNECTED RECEPTION UNITS

BACKGROUND OF THE INVENTION

1. Field of the Invention

The present invention relates to a paper processing apparatus for processing papers such as paper money and the like.

2. Description of the Related Art

As a kind of paper processing apparatus, so far there has been known a consumer transaction facility (Cash Dispenser (CD), Automatic Teller Machine (ATM), and so on) provided at banks and other financial institutions, for executing transactions such as receipt of money, payment, etc.

As a consumer transaction facility as mentioned above, in Japan, a so-called recycle machine for making transactions of payment using not only paper moneys stored in a consumer transaction facility by a bank or other financial institutions in advance but also paper moneys received from customers has been mainly used. On the other hand, in countries other than Japan, there are not many transactions of receipt of money made by general customers and most of their transactions are payment transactions. Demands for transactions of receipt of money greatly vary with the place, and even if there is a case that receipt of money is required, a transaction facility is used as a safe for receiving paper moneys from a shop owner in most of such cases.

Here, a recycle machine for using paper moneys received from a customer for payment to other customers needs to have a built-in discrimination apparatus highly developed for strictly discriminating genuine paper moneys from forged ones among the received paper moneys, because it is not clear which customer will have the received paper moneys, thus the cost is extremely high.

On the other hand, a payment-dedicated machine may only perform simple discrimination processing like discriminating of two-ply paper moneys for example, because only paper moneys identified as genuine papers and stored in advance by a financial institution are used for payment. Thus, its cost is far lower than that of a recycle machine, like in the ratio of one to seven.

Even in a case that a transaction for receipt of money is required, if a machine in which received paper moneys are only stored and are not used for payment is used in such case, more sophisticated discrimination processing than the above payment-dedicated machine is required but strict discrimination processing is not required in many cases compared to a recycle machine, because it is easy to associate the received paper moneys with the customers who fed the moneys in the machine.

In view of the above-described circumstances, in countries other than Japan, a payment-dedicated machine is provided only when transactions of payment are required, and a recycle machine is provided only when transactions for receipt of money are also required, or a payment-dedicated machine and a recycle machine are provided side by side.

Thus, in countries other than Japan, provision of payment-dedicated machines is enough in many cases because of differences in matters of each country or differences in local areas of one country, etc., and demands for receipt of money greatly vary even when transactions for receipt of money are required. Here, when services for carrying out receipt of money are required, even if a demand for receipt of money is remarkably poor compared to a demand for payment, it is necessary to provide a payment-dedicated machine and a receipt-dedicated machine side by side or to provide a recycle machine like in the case of a great demand for receipt of money. As a result, in order to satisfy a poor demand for receipt of money, it is necessary to invest a large amount of money which is as much as that in the case of a great demand for receipt of money and disproportionate to a poor demand for receipt of money, and such investment will be wasted.

SUMMARY OF THE INVENTION

In view of the forgoing, it is an object of the present invention to provide a paper processing apparatus of low cost that is capable of performing receipt of papers for which demand is poor such as receipt of moneys and the like.

To achieve the above-mentioned object, the present invention provides the first paper processing apparatus, in which papers are fed one by one from a first paper storing section for storing papers delivered to an exterior, conveyed on a predetermined first conveyance path, temporarily stored in a predetermined temporary storing section, and delivered from a predetermined paper delivery section in a block, and also papers having difficulties with delivery after being fed from the first paper storing section are led to a second conveyance path which is a divergent path of the first conveyance path and stored in a predetermined second paper storing section, the paper processing apparatus comprising:

a third conveyance path for receiving papers from the exterior and leading the received papers to the first conveyance path meeting the third conveyance path.

Here, the first paper processing apparatus, further comprising a mechanism for processing exterior papers wherein papers coming through the third conveyance path and further the first conveyance path are temporarily stored in the temporary storing section, and the temporarily stored papers are led to the second conveyance path and are stored in the second paper storing section. In this case, the mechanism for processing exterior papers may lead papers stored in the temporary storing section to the second conveyance path, and store the led papers in the second paper storing section or return the led papers to the exterior from the paper delivery section according to operation.

Since the first paper processing apparatus of the present invention has the third conveyance path, only by combining this apparatus with a paper receipt unit which will be described later, etc. and sending the papers from the exterior to the first conveyance path via the third conveyance path, processing for receiving papers (receipt processing for paper moneys) can be carried out in this apparatus, using a mechanism for paper delivery processing such as a mechanism for conveying papers, a temporary storing section, a paper delivery section and the second paper storing section. And also, even if the first paper processing apparatus is used as a delivery-dedicated machine (a payment-dedicated machine in the case of a consumer transaction facility as described above), compared with a machine that cannot be combined with a paper receipt unit, there will be only a slight increase in the cost since only the above-described third conveyance path is added to this apparatus.

To achieve the above-mentioned object, the present invention also provides the second paper processing apparatus comprising a paper delivery unit in which papers are fed one by one from a first paper storing section for storing papers to be delivered to an exterior, conveyed on a predetermined first conveyance path, temporarily stored in a predetermined temporary storing section, and then delivered from a predetermined paper delivery section in a block to the exterior, and also papers having difficulties with delivery after being fed from the first paper storing section are led to a second conveyance path which is a divergent path of the first conveyance path and stored in a predetermined second paper storing section; and a paper receipt unit arranged on an upper side of the paper delivery unit, for receiving papers fed from the exterior, wherein the paper delivery unit has a third conveyance path for receiving papers from the exterior and sending the received papers to the first conveyance path meeting the third conveyance path, and wherein the paper receipt unit has a fourth conveyance path for transmitting the papers fed from the exterior and received one by one to the third conveyance path.

Here, like the first paper processing apparatus of the present invention, in the second paper processing apparatus of the present invention, it is preferable that the paper delivery unit has a mechanism for processing exterior papers in which papers coming through the third conveyance path and further the first conveyance path are temporarily stored in the temporary storing section, and the temporarily stored papers are led to the second conveyance path and stored in the second paper storing section. Or, the mechanism for processing exterior papers may lead papers stored in the temporary storing section to the second conveyance path, and store the led papers in the second paper storing section or return the led papers to the exterior from the paper delivery section according to operation.

The second paper processing apparatus of the present invention has a paper receipt unit for receiving papers (receipt of money for paper moneys) that is arranged on the upper side of the paper delivery unit having the same structure as that of the first paper processing apparatus. In the second paper processing apparatus, a usable part in the mechanism of the paper delivery unit (a portion performing payment transactions in the case of handling paper moneys) may be used as it is, the paper receipt unit may have only a mechanism specific to receipt of papers, and not only paper delivery processing (payment processing for paper moneys) but also paper receipt processing (money receipt processing for paper moneys) can be carried out without increasing the cost.

To achieve the above-mentioned object, the present invention also provides the third paper processing apparatus comprising a cassette mounting section for receiving and supporting at least one of paper storing cassettes of a first type which is removably mounted and stores papers to be delivered to an exterior and at least one of paper storing cassettes of a second type which is removably mounted and has a structure for storing papers conveyed;

a mechanism for delivering papers in which papers are fed one by one from a paper storing cassette of the first type which stores papers to be delivered to an exterior and is mounted on the cassette mounting section, conveyed on a predetermined first conveyance path, and temporarily stored in a predetermined temporary storing section, and then the temporarily stored papers are delivered from a predetermined paper delivery section in a block to the exterior;

a mechanism for collecting papers in which papers having difficulties with delivery after being fed from the paper storing cassette of the first type are led to a second conveyance path which is a divergent path of the first conveyance path and stored in a paper storing cassette of the second type mounted on the cassette mounting section; and a mechanism for processing exterior papers in which papers fed from the exterior are received, conveyed on a third conveyance path meeting the first conveyance path and further the first conveyance path, and temporarily stored in the temporary storing section, and then the temporarily stored papers are led to the second conveyance path and stored in a paper storing cassette of the second type mounted on the cassette mounting section.

Here, in the above third paper processing apparatus, it is preferable that the mechanism for processing exterior papers leads papers stored in the temporary storing section to the second conveyance path, and stores the led papers in a paper storing cassette of the second type mounted on the cassette mounting section or returns the led papers to the exterior from the paper delivery section according to operation.

Also, in the third paper processing apparatus, it is preferable that the cassette mounting section is capable of having at least one of cassette mounting boxes of a first type for mounting a paper storing cassette of the first type and at least one of cassette mounting boxes of a second type for mounting a paper storing cassette of the second type, and capable of having at least one of cassette mounting boxes of the first or second type which is optional. Further, it is preferable that the cassette mounting section receives the paper storing cassettes of the first and second type respectively by the cassette mounting boxes of the first and second type arranged in the cassette mounting section and supports these paper storing cassettes of the first and second type by interposing these cassette mounting boxes of the first and second type.

Like the above-described paper processing apparatus, the third paper processing apparatus of the present invention has a structure for receiving the papers fed from the exterior, conveying them on the third conveyance path, and sending the conveyed papers to the first conveyance path. Therefore, only by combining this apparatus with a paper receipt unit, etc. and sending the papers fed from the exterior to the first conveyance path via the third conveyance path, processing for receiving papers can be carried in this apparatus using the mechanism of paper delivery processing. And also, even if the third paper processing apparatus is used as a machine dedicated to paper delivery (a payment-dedicated machine in the case of handling paper moneys), compared with conventional machines, there will be only a slight increase in the cost since only the above-described third conveyance path is added to this apparatus.

Moreover, since the third paper processing apparatus has a cassette mounting section that mounts a cassette for storing papers, it is convenient to handle the papers in this apparatus. Further, since optional numbers of the cassette mounting boxes of the first and second type can be arranged on the cassette mounting section as long as the number is equal to or lower than the maximum number, by combining this apparatus with a paper receipt unit, it is possible to meet various demands in which quantities of papers handled in paper delivery processing or paper receipt processing are different.

To achieve the above-mentioned object, the present invention also provides the fourth paper processing apparatus comprising a cassette mounting section for receiving and supporting at least one of paper storing cassettes of a first type which is removably mounted and stores papers to be delivered to an exterior and at least one of paper storing cassettes of a second type which is removably mounted and has a structure for storing papers conveyed;

a mechanism for delivering papers in which papers are fed one by one from a paper storing cassette of the first type which stores papers to be delivered to an exterior and is mounted on the cassette mounting section, conveyed on a predetermined first conveyance path, and temporarily stored in a predetermined temporary storing section, and then the temporarily stored papers are delivered from a predetermined paper delivery section in a block to the exterior;

a paper delivery unit having a mechanism for collecting papers in which papers having difficulties with delivery after being fed from the paper storing cassette of the first type are led to a second conveyance path which is a divergent path of the first conveyance path, and stored in a paper storing cassette of the second type mounted on the cassette mounting section; and a paper receipt unit arranged on an upper side of the paper delivery unit, for receiving papers fed from the exterior;

wherein the paper delivery unit has a mechanism for processing exterior papers in which papers fed from the exterior are received and conveyed on a third conveyance path meeting the first conveyance path and further the first conveyance path, and the conveyed papers are temporarily stored in the temporary storing section, and then the temporarily stored papers are led to the second conveyance path and stored in a paper storing cassette of the second type mounted on the cassette mounting section; and wherein the paper receipt unit has a mechanism for conveying exterior papers in which the papers fed one by one from the exterior are conveyed on a fourth conveyance path meeting the third conveyance path and sent to the third conveyance path.

Here, in the fourth paper processing apparatus, the mechanism for processing exterior papers may lead papers stored in the temporary storing section to the second conveyance path, and store the led papers in a paper storing cassette of the second type mounted on the cassette mounting section or return the led papers to the exterior from the paper delivery section according to operation.

Further, in the fourth paper processing apparatus, it is preferable that the cassette mounting section is capable of having at least one of cassette mounting boxes of a first type for mounting a paper storing cassette of the first type and at least one of cassette mounting boxes of a second type for mounting a paper storing cassette of the second type and capable of having at least one cassette mounting box of the first or second type. Further, it is preferable that the cassette mounting section receives the paper storing cassettes of the first and second type respectively by the cassette mounting boxes of the first and second type arranged in the cassette mounting section and supports these paper storing cassettes of the first and second type by interposing these cassette mounting boxes of the first and second type The fourth paper processing apparatus of the present invention has a paper delivery unit having the same structure as that of the third paper processing apparatus, and a paper receipt unit arranged on the upper side of the paper delivery unit. In this apparatus, a part in the mechanism of the paper delivery unit which can be used for paper receipt processing may be used as it is, the paper receipt unit may have only a mechanism specific to receipt of papers, and processing for both paper delivery and paper receipt can be carried out without increasing the cost.

Also, like the third paper processing apparatus, the fourth paper processing apparatus of the present invention has a cassette mounting section and provides that the paper storing cassettes of the first and second type are removably mounted on the cassette mounting section, and therefore it is convenient to handle the papers. Furthermore, the number of the paper storing cassettes of these two types to be mounted on the cassette mounting section is optional as long as the number is equal to or less than the maximum number for mounting. By providing these cassettes in this way, it is possible to meet and adjust to both poor and great demands for paper receipt processing.

DETAILED DESCRIPTION OF PREFERRED EMBODIMENTS

Hereinafter, a paper processing apparatus according to embodiments of the present invention will be described.

Figure 1:
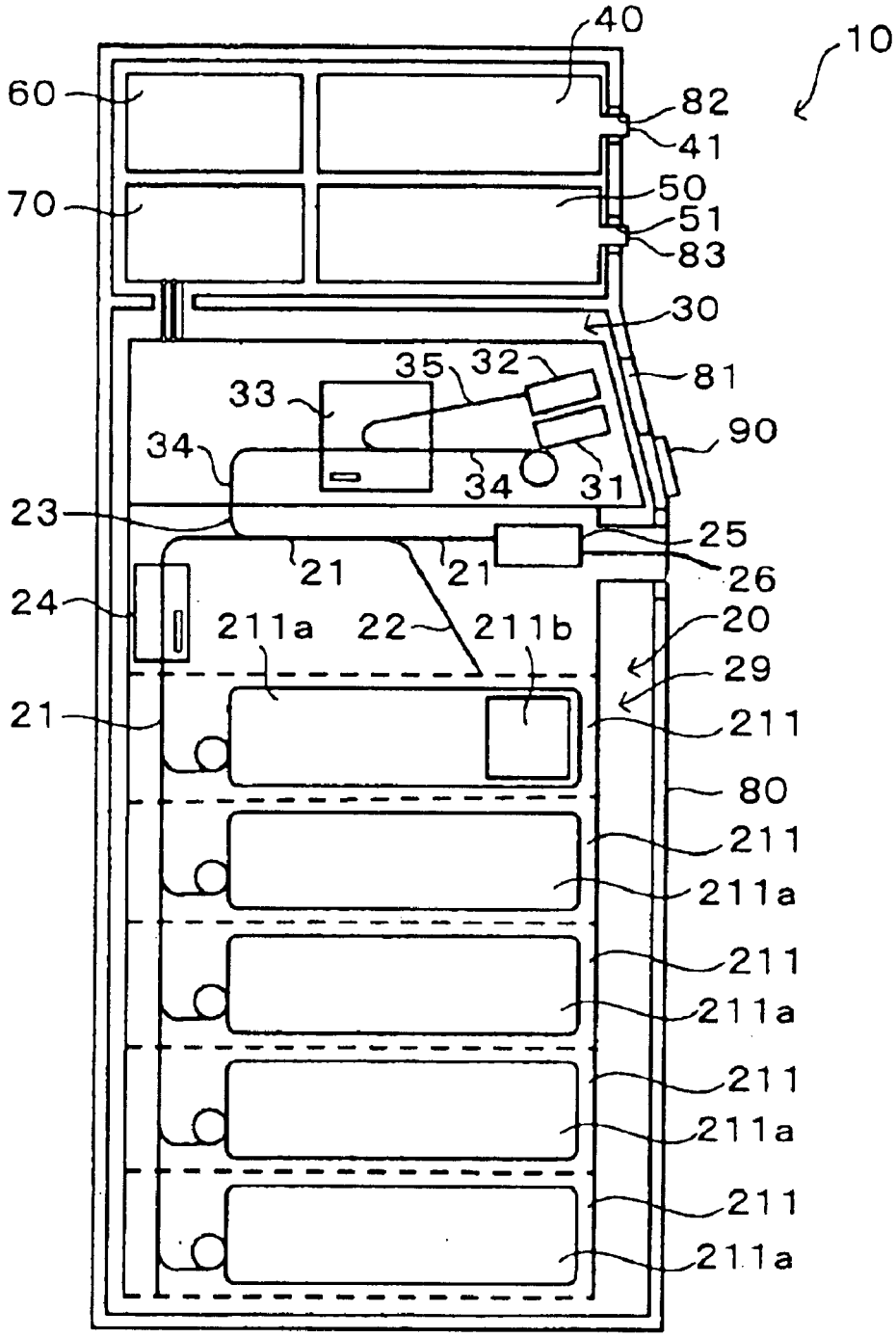
FIG. 1 is a view showing the entire structure of a consumer transaction facility according to an embodiment of the present invention.

FIG. 1 is a view showing the entire structure of a consumer transaction facility according to an embodiment of the present invention.

Figure 5:
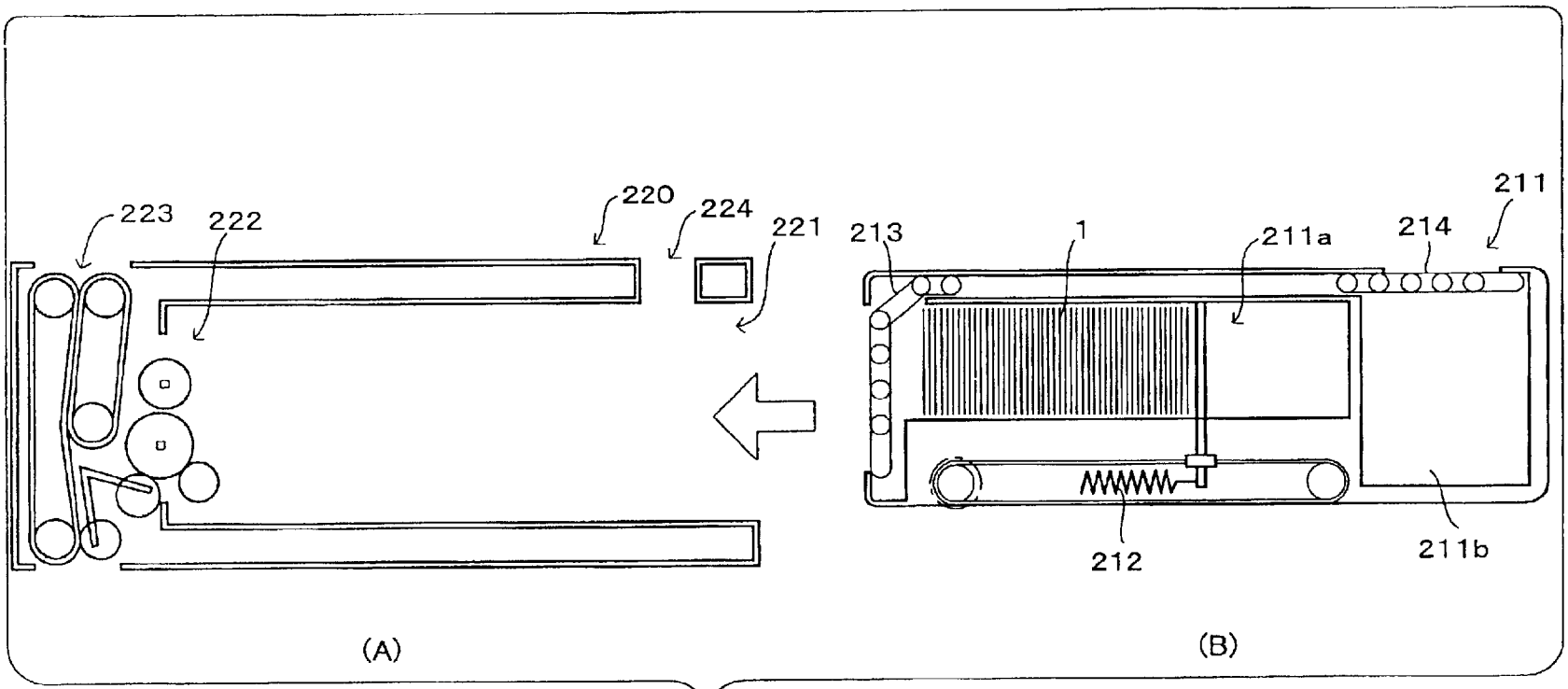
FIG. 5 is a view showing (A) a cassette mounting box arranged in the uppermost part of a cassette mounting section in a payment unit of the consumer transaction facility shown in FIG. 1 and (B) a cassette to be held in the cassette mounting box.

As shown in FIG. 1, the consumer transaction facility 10 has a payment unit 20 and a money receipt unit 30 arranged on the payment unit 20. Further, on the money receipt unit 30, a card processing section 40, a receipt processing section 50, a control section 60 and a power supply section 70 are provided. These elements are arranged in the inside of a frame 80 and comprise an apparatus. Also, on the front of the frame 80, there are provided operation keys such as ten keys, etc. operated by a customer and an operation panel 90 having a display section for displaying necessary information to a customer. On a cassette mounting section 29 of the payment unit 20, plural cassettes 211 for storing paper moneys according to denomination are removably mounted. The cassette mounting section 29 has a cassette mounting box 220 which will be described later referring to part (A) of FIG. 5, and a cassette 211 which will be described later referring to part (B) of FIG. 5 is mounted on the cassette mounting box 220.

Here, among these plural cassettes 211, a cassette placed on the highest position has the first storing section 211*a* for storing paper moneys to be paid and the second storing section 211*b* for storing paper moneys having difficulties with payment among the paper moneys for payment fed from these cassettes. On the other hand, the plural cassettes 211 other than the one placed on the highest position have only the first storing sections 211*a* for storing paper moneys to be paid. Paper moneys stored in these plural cassettes 211 are fed one by one from these cassettes. Also, in the payment unit 20, as conveyance paths for conveying paper moneys, there are the first conveyance path 21 for conveying paper moneys fed from the cassettes 211, the second conveyance path 22 for conveying paper moneys unsuitable for payment among paper moneys fed from the cassettes 211 to the second storing section 211*b* of the top cassette, and the third conveyance path 23 for conveying paper moneys transmitted from the money receipt unit 30 and sending them to the first conveyance path.

On the first conveyance path 21, a payment discrimination section 24 for discriminating paper moneys for payment is provided, in which simple discrimination such as discrimination of two-ply paper moneys being sent is performed.

Moreover, on the first conveyance path, there is a temporary storing section 25 for temporarily storing paper moneys conveyed one by one to pay them in the block. Although details will be described later, paper moneys stored in the temporary storing section 25 are usually delivered in the block from a paper money delivery aperture 26 to the exterior.

Also, the money receipt unit 30 arranged on the payment unit 20 cannot perform money receipt processing alone, leaves the payment unit to perform most part of the mechanism for money receipt processing and has only a mechanism required for and dedicated to money receipt processing.

The money receipt unit 30 has a paper money receiving aperture 31 in which stacked paper moneys are inserted and a paper money returning aperture 32 for returning paper moneys unsuitable for receipt to a customer. An aperture 81 for inserting and returning of paper moneys is formed in front of the paper money receiving aperture 31 and the paper money returning aperture 32 of the frame 80. Also, the money receipt unit 30 has the fourth conveyance path 34 for conveying paper moneys inserted in the paper money receiving aperture 31 and sent from the aperture 31, a money receipt discrimination section 33 arranged on the fourth conveyance path, and the fifth conveyance path 35 which is a divergent path of the fourth conveyance path 34 and meets the paper money returning aperture 32. The money receipt discrimination section 33 performs very strict discrimination for judging whether paper moneys should be accepted or not, such as judging of genuineness or denomination, etc.

Further, the sequence of paper money conveyance within the payment unit 20 and the money receipt unit 30 will be described later.

As to the card processing section 40, a cash card is inserted in this section from a card insertion aperture 41, and in the card processing section 40, a password magnetically recorded in the inserted cash card is read and checked if it is the same password as that input by the customer operating the operation panel 90, and further, information processing necessary to a transaction for the customer such as inquiring a host computer (not shown) about the balance in an account of the customer and the like is performed.

On the front surface of the card processing 40 within the frame 80, an aperture 82 for enabling a cash card to be inserted in the card processing 40 is provided.

Also, the receipt processing section 50 prints the result of a payment transaction or a money receipt transaction for a customer on a receipt and outputs the receipt from a receipt output aperture 51 to the customer. The front surface of the receipt processing section 50 has an aperture 83 for enabling output of receipt.

The control section 60 performs the entire control over the consumer transaction facility 10. The control section 60 also has control over conveyance of paper moneys in the payment unit 20 and the money receipt unit 30. That is, by the control section 60, sequence control forming a mechanism for processing exterior papers, a mechanism for delivering papers and a mechanism for collecting papers according to the present invention is realized.

The power supply section 70 is supplied with commercial electronic power for example, converts the supplied electric power into electric power suitable for each section of the consumer transaction facility 10 and provides the converted power to these sections.

The consumer transaction facility 10 shown in FIG. 1 is an apparatus for performing not only payment processing but also money receipt processing. If it is enough to carry out payment processing only, the money receipt unit 30 will be removed from a structure of the consumer transaction facility 10. Even in this case, the shape of the frame 80 to be used will not be changed except that the aperture 81 for the money receipt unit 30 is closed.

Figure 2:
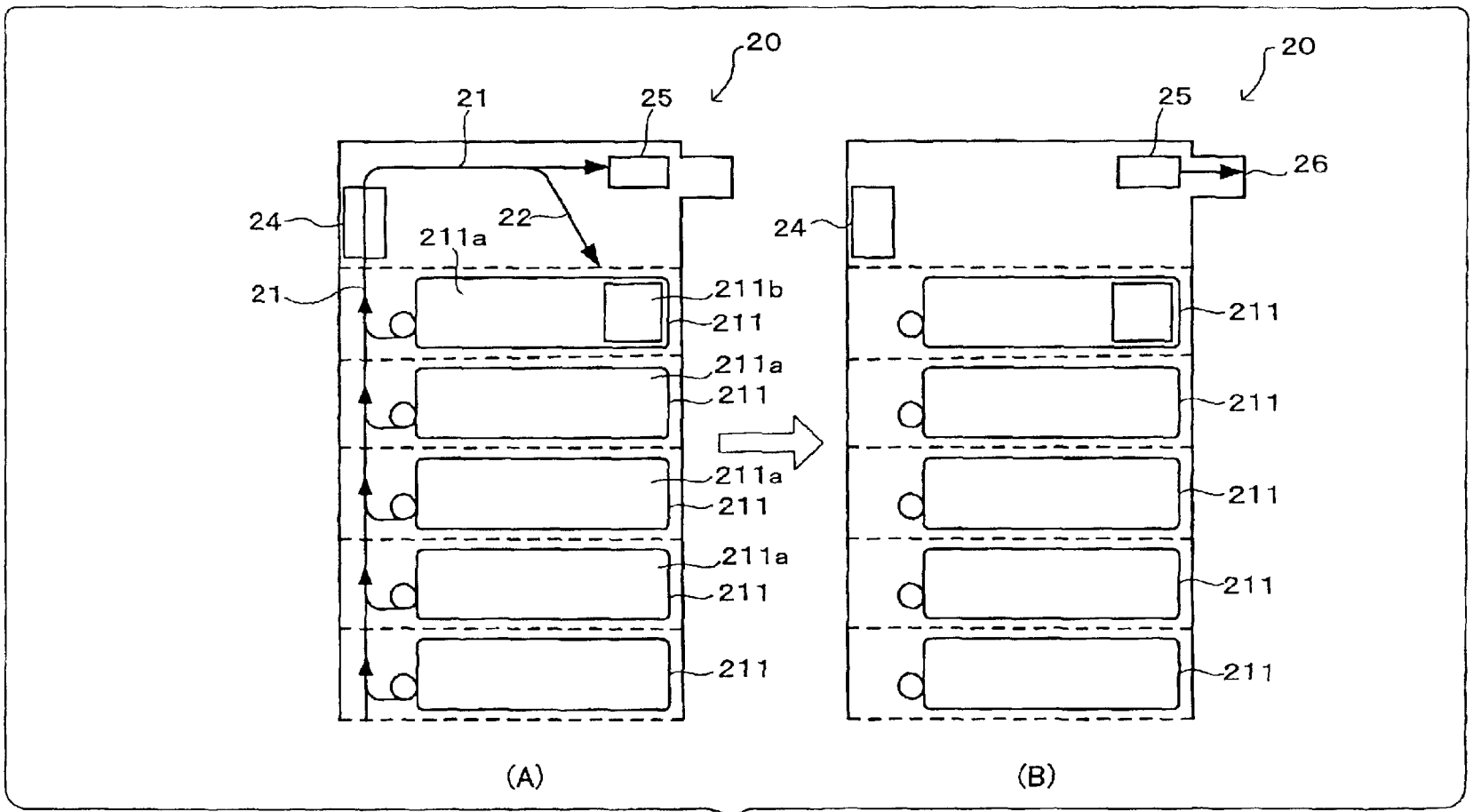
FIG. 2 is a view showing a payment conveyance path in a payment unit of the consumer transaction facility shown in FIG. 1.

FIG. 2 is a view showing a payment conveyance path in a payment unit of the consumer transaction facility shown in FIG. 1.

In this consumer transaction facility, when a request for payment is received from a customer, as shown in part (A) of FIG. 2, paper moneys are fed one by one from a first storing section 211*a* of any of plural cassettes 211. The fed paper moneys go through the first conveyance path 21 and are discriminated by the payment discrimination section 24. And further, while paper moneys that can be paid are stored in the temporary storing section 25, paper moneys unsuitable for payment such as two-ply papers are led to the conveyance path 22 and stored in the second storing section 211*b*. In the consumer transaction facility here, necessary information processing such as communication with a host computer is carried out using the time until paper moneys of which amount meets a transaction with a customer are stored in the temporary storing section 25.

When it is found by the communication with the host computer that the balance in an account of the customer is less than the amount to be paid in the transaction in spite that necessary moneys have been stored in the temporary storing section 25, or when the transaction is cancelled by the customer using the operation panel 90 after necessary moneys were stored in the temporary storing section 25, the paper moneys stacked in the temporary storing section 25 go backwards (left hand in part (A) of FIG. 2) as they are on the first conveyance path 21, and then change the direction again to go forward in the original direction (right hand in part (A) of FIG. 2) and pass the second conveyance path 22 to be stored in the second storing section 211*b*.

Also, after necessary moneys were stored in the temporary storing section 25, when it is possible to carry out the transaction for the customer and the customer operates the operation panel 90 to continue the transaction, as shown in part (B) of FIG. 2, the paper moneys temporarily stored in the temporary storing section 25 are conveyed to the paper money delivery aperture 26 in the block as they are kept being stacked and become ready to be received by the customer. Then, when the customer receives the paper moneys in the paper money delivery aperture 26, the transaction is completed.

However, when the customer has forgotten to take the paper moneys in spite that the moneys were conveyed to the paper money delivery aperture 26, i.e., when the predetermined time has passed since the paper moneys were conveyed to the paper money delivery aperture 26, the paper moneys will be conveyed as follows.

Figure 3:
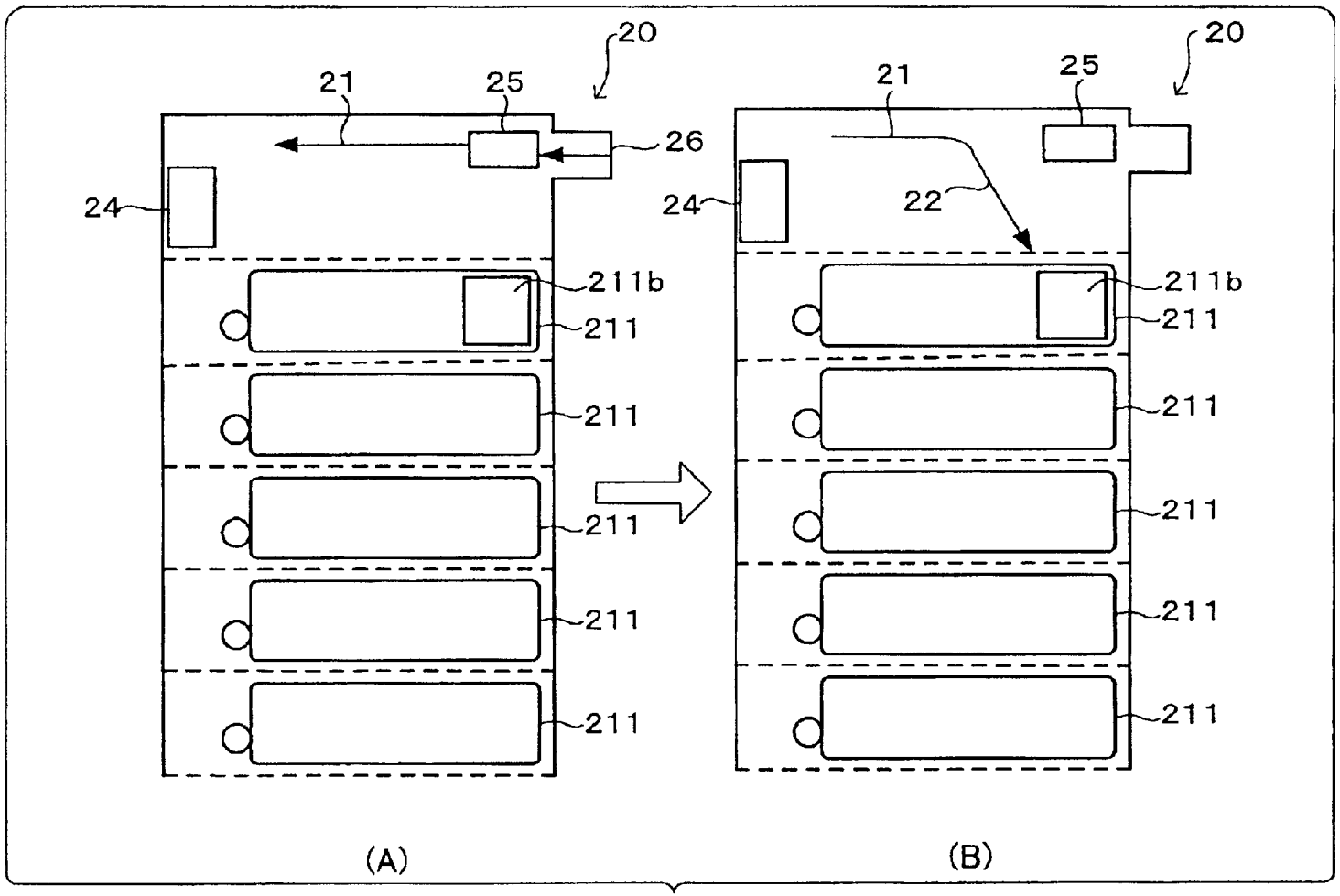
FIG. 3 is a view showing a conveyance path when a customer forgets to take paper moneys out of a paper money delivery aperture.

FIG. 3 is a view showing a conveyance path when a customer forgets to take paper moneys out of a paper money delivery aperture.

When the predetermined time elapses without receipt of paper moneys by the customer in spite that the paper moneys have been conveyed to the paper money delivery aperture 26, the paper moneys in the paper money delivery aperture 26 go back in the direction shown in part (A) of FIG. 3 as they are kept being stacked, and further, like the case that the customer cancels the payment transaction in a state that the paper moneys are stored in the temporary storing section 25, the paper moneys in the paper money delivery aperture 26 go back on the first conveyance path 21. Then, as shown in part (B) of FIG. 3, the direction is reversed and the paper moneys advance on the second conveyance path 22 which is a divergent path of the first conveyance path 21 to be stored in the second storing section 211*b*.

Figure 4:
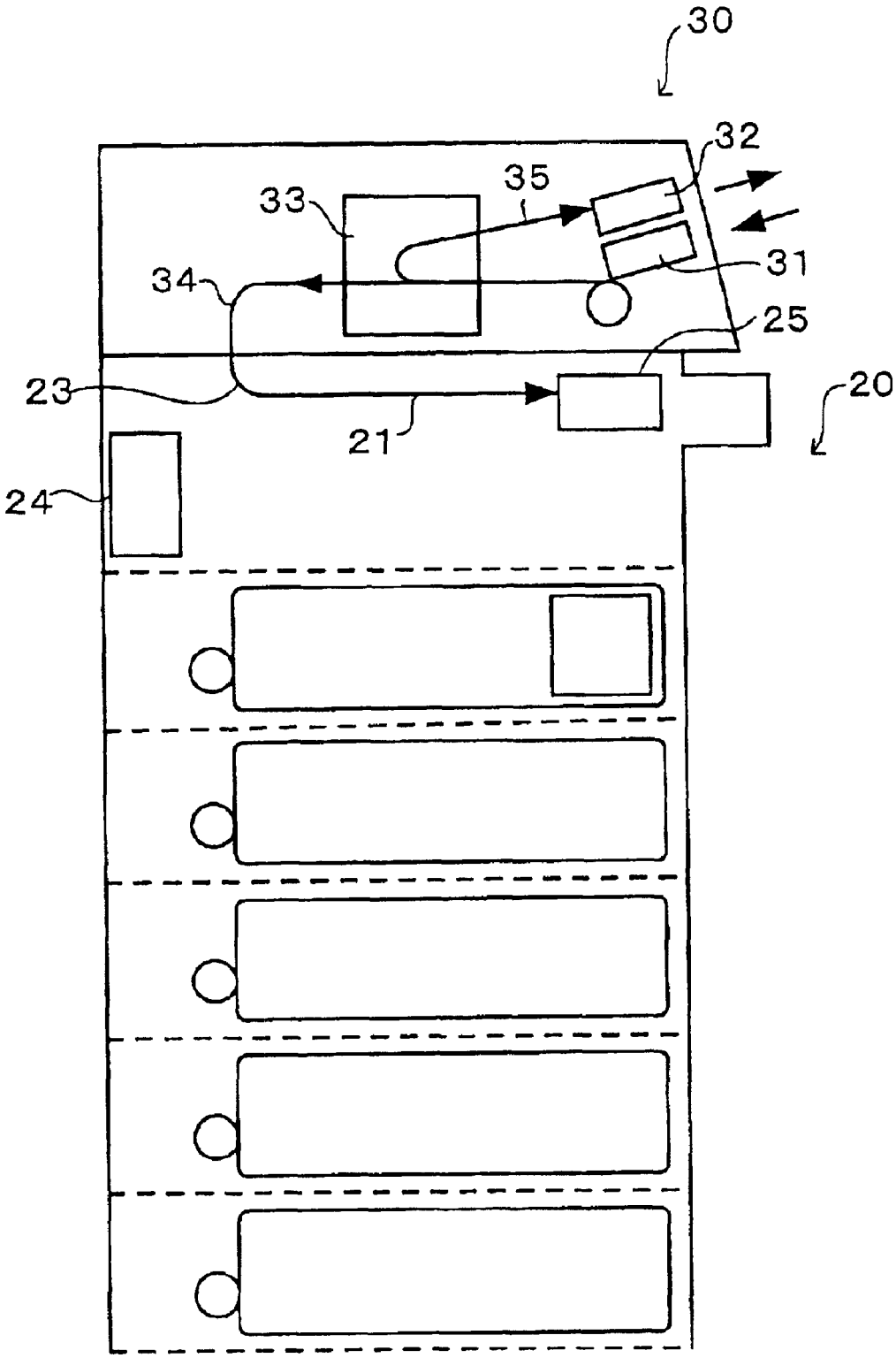
FIG. 4 is a view showing a conveyance path for conveying paper moneys at the time of receiving moneys.

FIG. 4 is a view showing a conveyance path for conveying paper moneys at the time of receipt of money.

In FIG. 4, the payment unit 20 and the money receipt unit 30 on the payment unit 20 are shown.

Paper moneys inserted in the paper money receiving aperture 31 of the money receipt unit 30 are fed one by one from the paper money receiving aperture 31, conveyed on the fourth conveyance path 34, and then discriminated by the money receipt discrimination section 33 arranged on the fourth conveyance path 34. Paper moneys judged to be unsuitable for receipt as a result of discrimination by the money receipt discrimination section 33 go through the fifth conveyance path 35 and conveyed to the paper money returning aperture 32 to be returned to a customer. Receivable paper moneys pass the money receipt discrimination section 33 and are transmitted from the fourth conveyance path 34 to the third conveyance path 23 provided in the payment unit 20 and further to the first conveyance path 21 of the payment unit 20 to be stored in the temporary storing section 25.

When all the paper moneys inserted in the paper money receiving aperture 31 except for the paper moneys to be returned from the paper money returning aperture 32 are stored in the temporary storing section 25, the amount of the stored paper moneys is displayed on the display section of the operation panel 90 (refer to FIG. 1) to the customer. When the customer orders continuation of money receipt processing using the operation panel 90, the paper moneys within the temporary storing section 25 go back on the first conveyance path 21 as shown in part (A) of FIG. 3 as they are kept being stacked and then reverse the direction as shown in part (B) of FIG. 3 to go through the second conveyance path 22 so that they are stored in the second storing section 211*b*.

Also, when the customer orders cancel of money receipt processing using the operation panel 90 (refer to FIG. 1) at the time when the received paper moneys are stored in the temporary storing section 25, the stored paper moneys of the customer are conveyed as shown in part (B) of FIG. 2 from the temporary storing section 25 to the paper delivery aperture 26 as they are kept being stacked so that they are returned to the customer.

In this way, also in money receipt processing, mechanisms of the payment unit 20 such as the first conveyance path 21, the second conveyance path 22, the temporary storing section 25, the paper delivery aperture 26 and the second storing section 211*b* are shared, and the money receipt unit 30 is composed of only sections unique to money receipt processing and cannot use the mechanisms of the payment unit 20.

Figure 6:
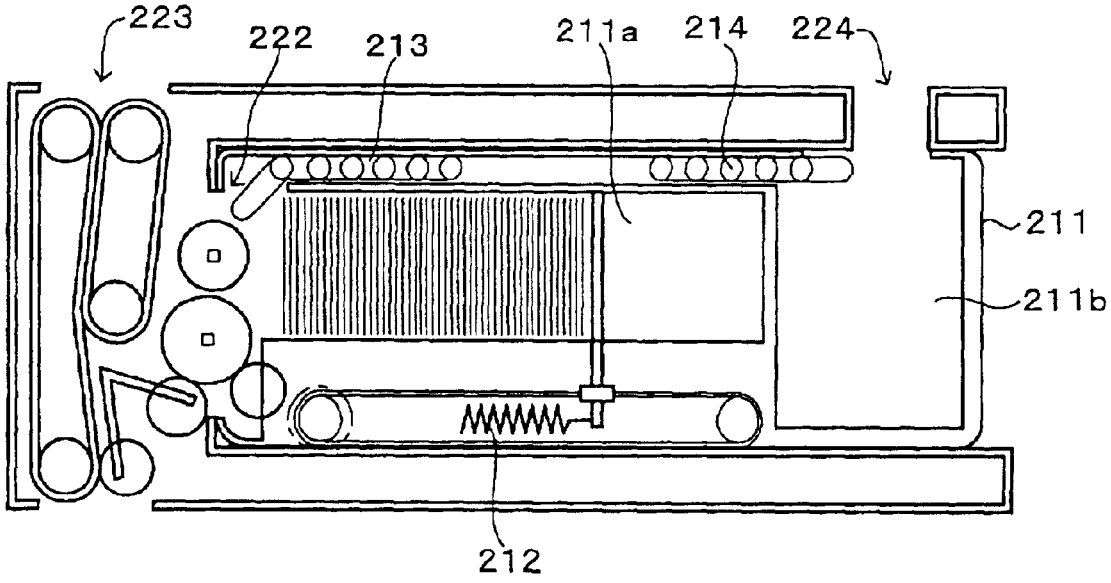
FIG. 6 is a view showing a state that the cassette shown in part (B) of FIG. 5 is being amounted on the cassette mounting box shown in part (A) of FIG. 5.

FIG. 5 is a view showing (A) a cassette mounting box arranged in the uppermost part of the cassette mounting section 29 in the payment unit 20 of the consumer transaction facility 10 shown in FIG. 1 and (B) a cassette to be held in the cassette mounting box. FIG. 6 is a view showing a state that the cassette shown in part (B) of FIG. 5 is being mounted on the cassette mounting box shown in part (A) of FIG. 5.

A cassette 211 shown in part (B) of FIG. 5 has the first storing section 211*a* for storing paper moneys 1 to be paid and the second storing section 211*b* for storing paper moneys conveyed. The paper moneys 1 in the first storing section 211*a* are pressed to the left in the figure by a spring 212. Also, in the cassette 211, the first shutter 213 is provided at an aperture of the first storing section 211*a* and the second shutter 214 is provided at an aperture of the second storing section 211*b*. These first and second shutters 213 and 214 are usually closed when they are not mounted on a cassette mounting box 220 shown in part (A) of FIG. 5 so that paper moneys inside them can not be easily touched.

The cassette mounting box 220 shown in part (A) of FIG. 5 to mount the cassette 211 has an aperture 221 for receiving the cassette 211 shown in the right of part (B) in FIG. 5, and there are provided in the left of part (A) in FIG. 5 a paper money feed mechanism 222 for feeding paper moneys one by one which are stored in the first storing section 211*a* of the cassette 211 and a conveyance mechanism 223 for conveying upwards these fed paper moneys or paper moneys fed from a cassette mounting box (not shown) arranged lower than the cassette mounting box 220. The conveyance mechanism 223 is a part of the first conveyance path shown in FIG. 1, etc.

Moreover, on the upper surface of the cassette mounting box 220 shown in part (A) of FIG. 5, there is an aperture 224 in the position corresponding to an aperture of the second storing section 211*b* of the cassette 211 shown in part (B) of FIG. 5.

FIG. 6 shows a state that the cassette 211 shown in part (B) of FIG. 5 is being amounted on the cassette mounting box 220 shown in part (A) of FIG. 5. During the process of mounting, engagement members (not shown) engage the shutter 213, the shutter 213 opens as shown in FIG. 6 when the cassette 211 is inserted further in the cassette mounting box 220, and the paper moneys 1 within the first storing section 211*a* face the paper money feed mechanism 222. Also, the other shutter 214 is connected to the shutter 213 through the intermediary of an engagement mechanism (not shown) and moves to the position shown in FIG. 6 in order to open an entrance of the second storing section 211*b* in connection with the motion that the shutter 213 opens.

In the state that the cassette 211 is mounted on the cassette mounting box 220 in this way, when the control section 60 shown in FIG. 1 orders feeding of paper moneys, the paper moneys 1 within the first storing section 211*a* are fed one by one by the paper money feed mechanism 222 and conveyed upwards by the conveyance mechanism 223.

Since the paper money feed mechanism 222 and the conveyance mechanism 223 are well-known conventional techniques, a detailed explanation of them has been omitted here.

Referring to FIGS. 5 and 6, there was given above the explanation of the uppermost cassette mounting box and the cassette mounted on the uppermost cassette mounting box among the multi-leveled cassette mounting boxes arranged in the cassette mounting section 29 shown in FIG. 1 and the plural cassettes mounted on these multi-leveled cassette mounting boxes. The cassettes shown in FIG. 1 other than the uppermost cassette have, as shown in the structure of part (B) in FIG. 5, the same structure as that of the cassette shown in part (B) of FIG. 5 except that they do not have the second storing section 211*b* and the second shutter 214, and that the first storing section 211*a* extends to the part of the second storing section 211*b* shown in part (B) of FIG. 5. Also, cassette mounting boxes to mount these cassettes are different from the cassette mounting box 220 shown in part (A) of FIG. 5 only in that the aperture 224 is not necessary, and there is no problem whether the aperture 224 is provided or not. Therefore, the cassettes other than the uppermost cassette and the cassette mounting boxes to mount these cassettes will not be explained.

FIGS. 7–11 show a structure and a performance of a conveyance path near to the temporary storing section 25 in the payment unit 20 shown in FIG. 1.

Paper moneys fed from the cassettes 211 and conveyed upwards go through the payment discrimination section 24 shown in FIG. 1, and advance on the first conveyance path 21 from the left to the right in FIG. 1.

Figure 7:
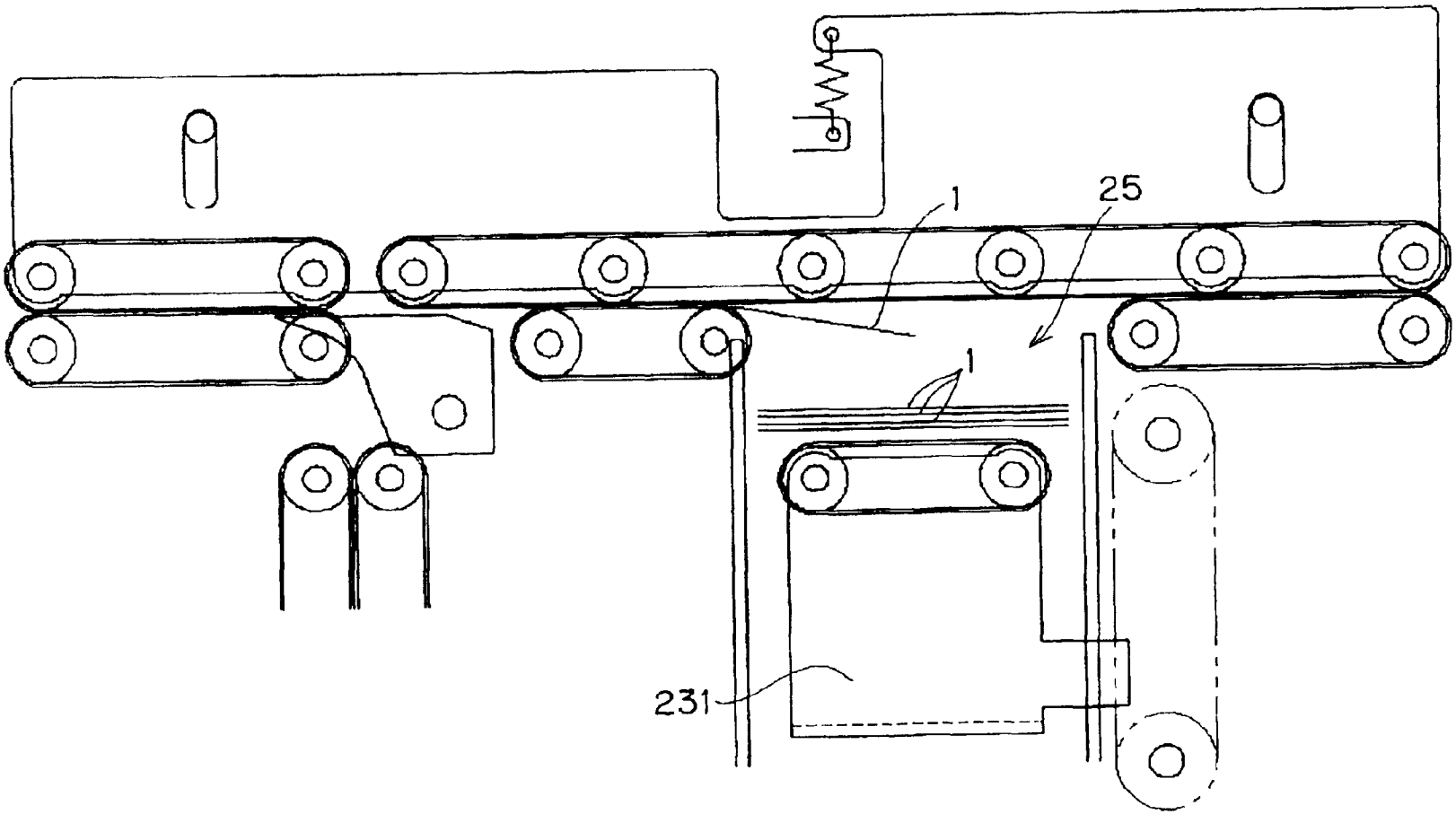
FIG. 7 is a view showing a structure and a performance of a conveyance path near to a temporary storing section in the payment unit shown in FIG. 1.

Paper moneys 1 advanced in this way are stored in the temporary storing section 25 formed as shown in FIG. 7. Here, a compression section 231 forming the bottom of the temporary storing section 25 is lowered and the temporary storing section 25 is widely opened.

The paper moneys 1 conveyed to the temporary storing section 25 are stacked within the temporary storing section 25.

Figure 8:
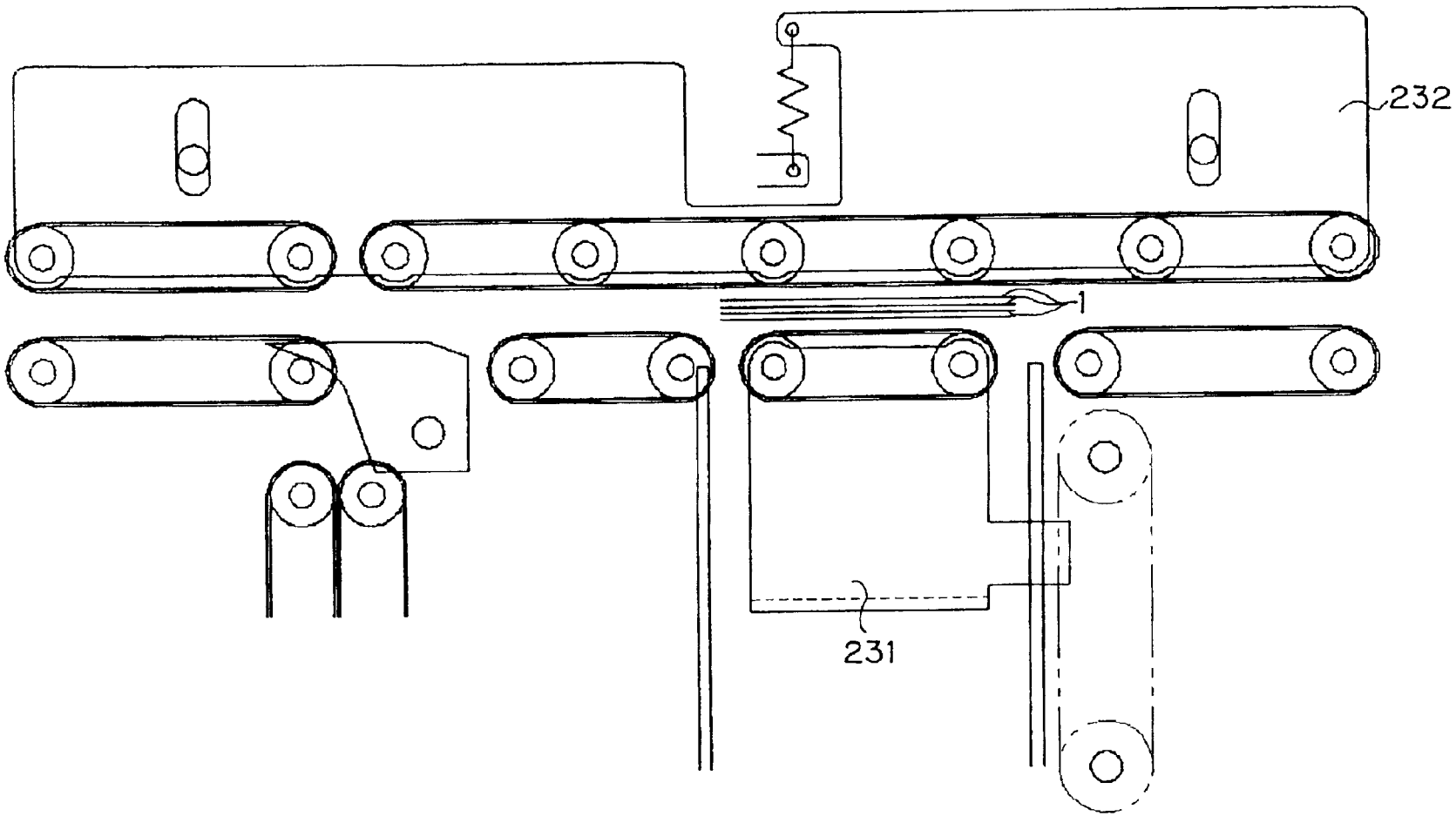
FIG. 8 is a view showing a structure and a performance of a conveyance path near to a temporary storing section in the payment unit shown in FIG. 1.

When paper moneys to be used for a transaction are stored in the temporary storing section 25, as shown in FIG. 8, the compression section 231 is lifted and an upper conveyance section 232 is also lifted to some extent. Then, the paper moneys 1 are sandwiched between the compression section 231 and the upper conveyance section 232.

Figure 9:
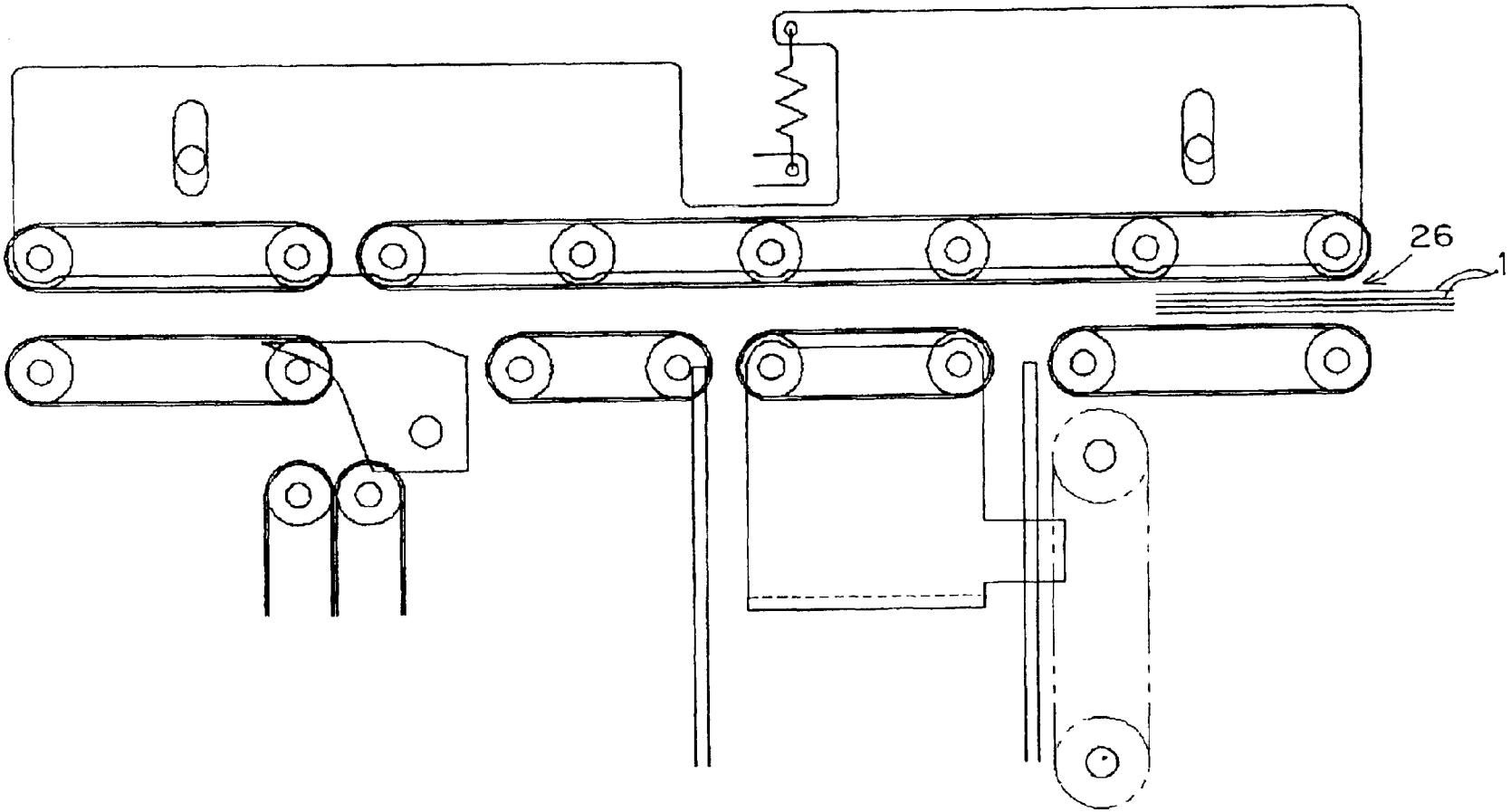
FIG. 9 is a view showing a structure and a performance of a conveyance path near to a temporary storing section in the payment unit shown in FIG. 1.

For providing the customer with the paper moneys (for delivering (in case of payment processing) or returning (in case of money receipt processing)), the paper moneys 1 are conveyed to the right in FIG. 8 as they are kept being stacked, and the ends of the paper moneys come out of the paper money delivery aperture 26 as shown in FIG. 9.

Figure 10:
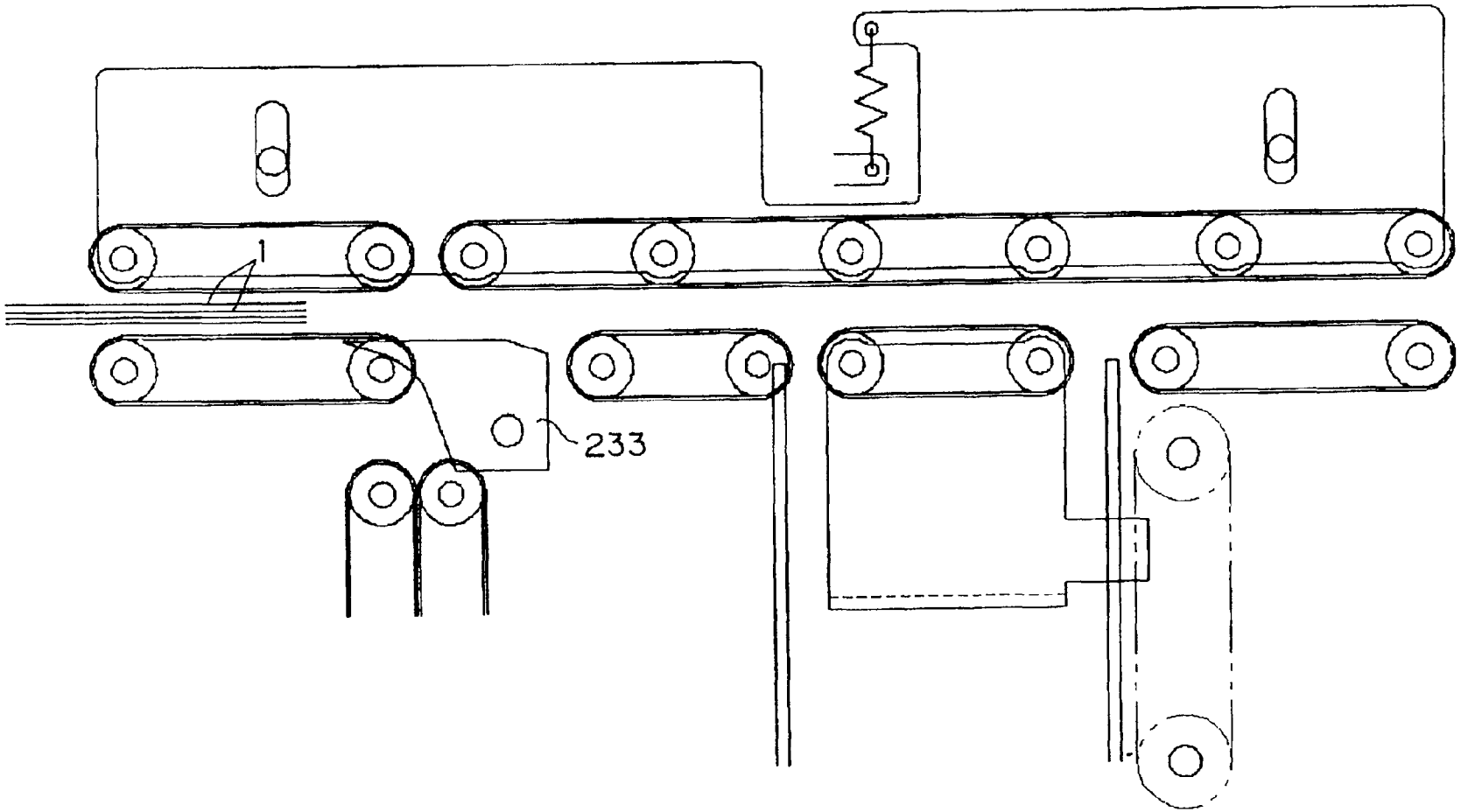
FIG. 10 is a view showing a structure and a performance of a conveyance path near to a temporary storing section in the payment unit shown in FIG. 1.
Figure 11:
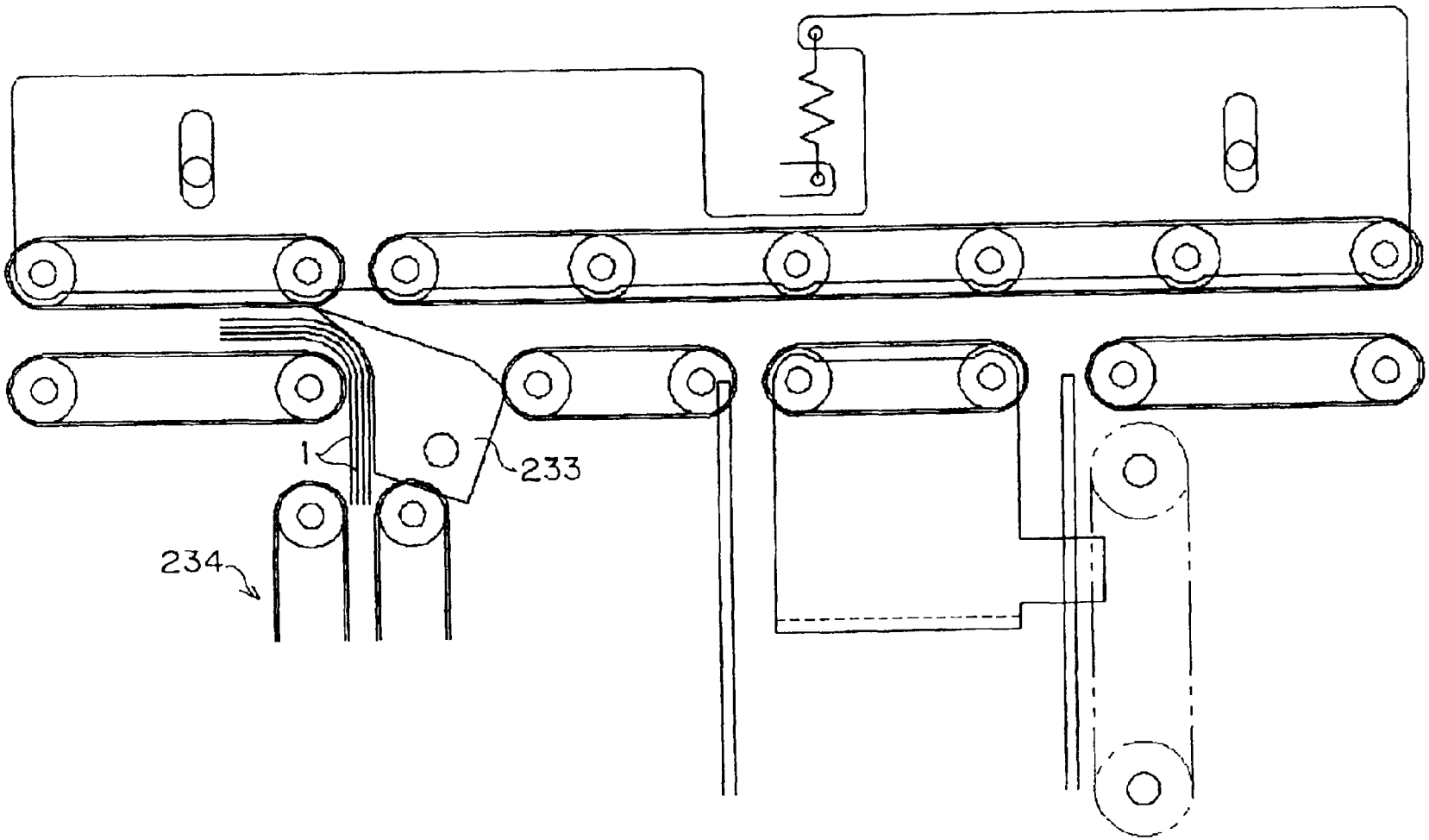
FIG. 11 is a view showing a structure and a performance of a conveyance path near to a temporary storing section in the payment unit shown in FIG. 1.

On the other hand, when the paper moneys 1 stored in the temporary storing section 25 are stored in the second storing section 211*b* shown in FIG. 1 instead of being given to the customer (when the customer cancels a transaction in payment processing or when the customer orders that a money receipt transaction should be continued) or when the customer has forgotten to take out the paper moneys 1 conveyed to the paper money delivery aperture 26 as shown in FIG. 9 (when the predetermined time has passed), the paper moneys 1 are conveyed as follows. First, the paper moneys 1 are conveyed to the left from the positions shown in FIG. 8 or 9 as they are kept being stacked, conveyed to the position over a gate 233 as shown in FIG. 10 and conveyed to the right by controlling the position of the gate 233 as shown in FIG. 11. And then, they are transmitted to a conveyance mechanism 234 forming the second conveyance path 22 shown in FIG. 1 and stored in the second storing section 211*b* shown in FIG. 1.

Next, the second embodiment of the present invention will be described.

Figure 12:
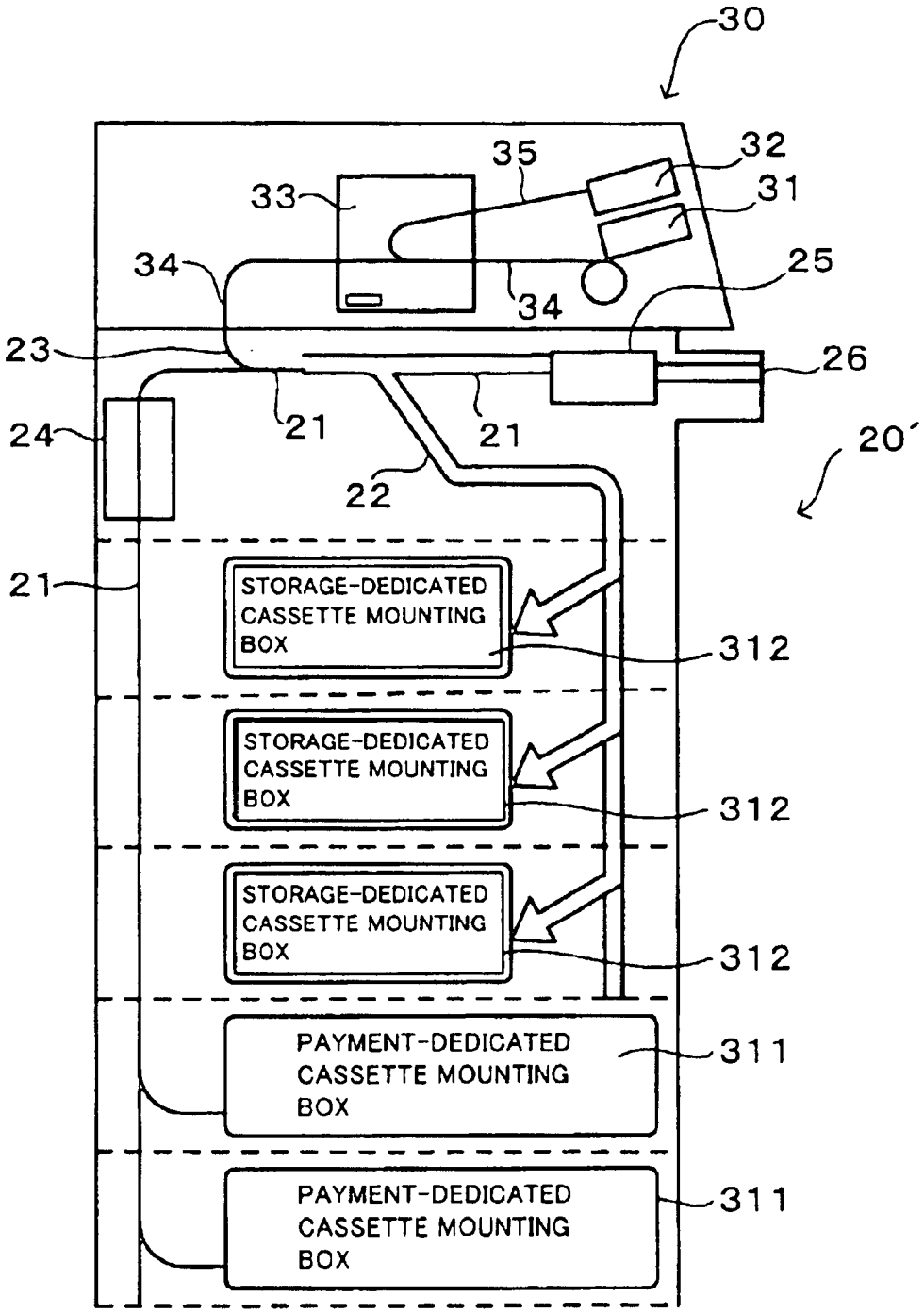
FIG. 12 is a view showing a structure including a payment unit and a money receipt unit in a paper processing apparatus according to the second embodiment of the present invention.

FIG. 12 is a view showing a structure including a payment unit and a money receipt unit in a paper processing apparatus according to the second embodiment of the present invention. The difference between the second embodiment and the first embodiment of which entire structure is shown in FIG. 1 will be described.

The cassette mounting section 29 of the payment unit 20 of the first embodiment shown in FIG. 1 has substantially the same plural cassette mounting boxes that are vertically arranged and these cassette mounting boxes have substantially the same cassettes 211 except that only the uppermost cassette has the second storing section 211*b*.

On the other hand, a payment unit 20' of the second embodiment shown in FIG. 12 has two payment-dedicated cassette mounting boxes and three storage-dedicated cassette mounting boxes arranged on the payment-dedicated cassette mounting boxes, and payment-dedicated cassettes 311 are mounted on the payment-dedicated cassette mounting boxes and storage-dedicated cassettes 312 are mounted on the storage-dedicated cassette mounting boxes.

For payment processing, paper moneys are fed from the payment-dedicated cassettes 311 and paper moneys that are not given to the customer among the paper moneys fed from the payment-dedicated cassettes 311 are stored in any of the plural storage-dedicated cassettes 312. Paper moneys received from a money receipt unit 30 except for paper moneys to be returned to the customer are also stored in any of the plural storage-dedicated cassettes 312.

The payment-dedicated cassettes 311 and payment-dedicated cassette mounting boxes to mount these payment-dedicated cassettes 311 have respectively the same structures as those of the cassettes other than the uppermost cassette and the cassette mounting boxes mounting these cassettes in the first embodiment as shown in FIG. 1, and they also correspond to the cassette and the cassette mounting box explained referring to FIGS. 5 and 6 in which the second storing section 211*b* and the accompanying facilities are removed and the size of the first storing section 211*a* is expanded. Therefore, structures of the payment-dedicated cassettes 311 and payment-dedicated cassette mounting boxes for mounting these cassettes will be omitted here.

Figure 13:
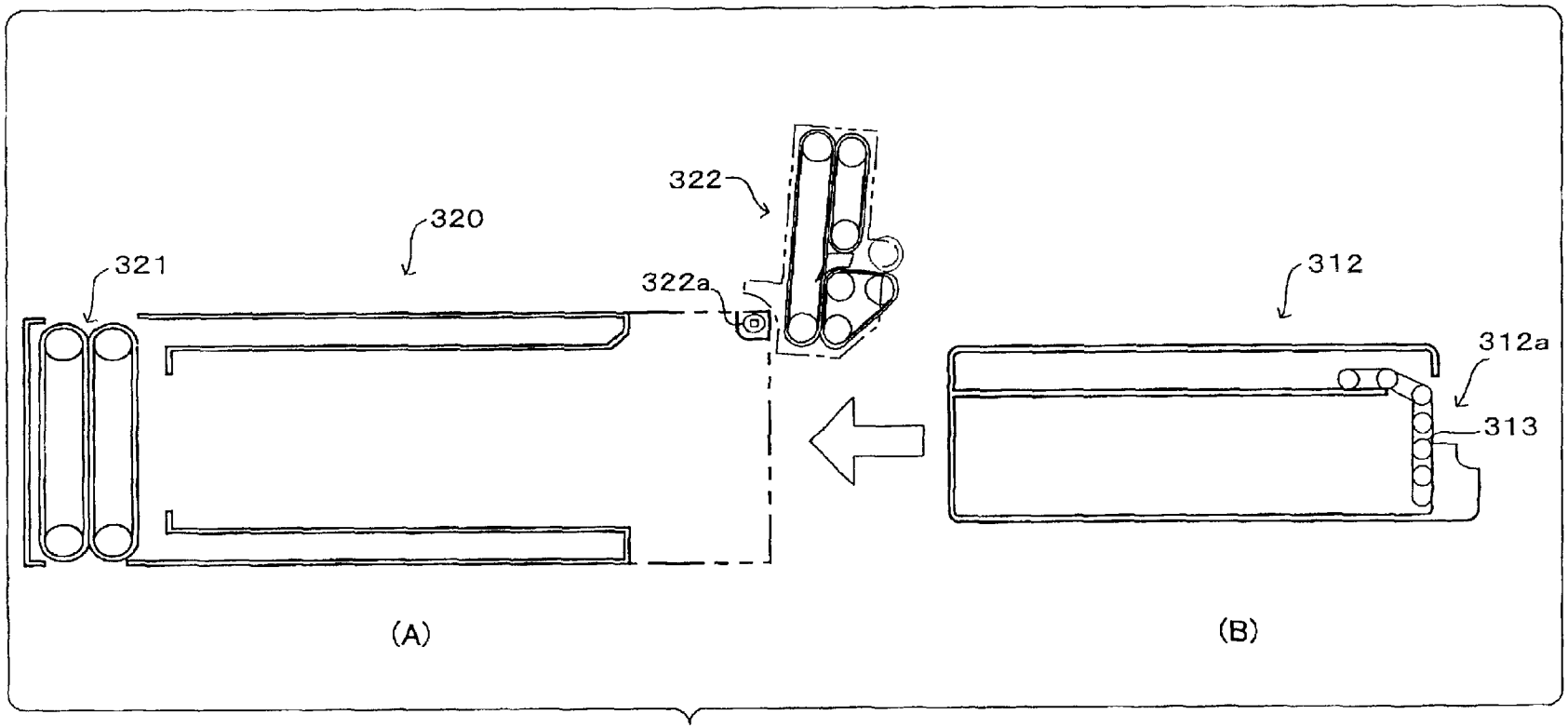
FIG. 13 is a view showing (A) a storage-dedicated cassette mounting box and (B) a storage-dedicated cassette to be mounted on the storage-dedicated cassette mounting box.
Figure 14:
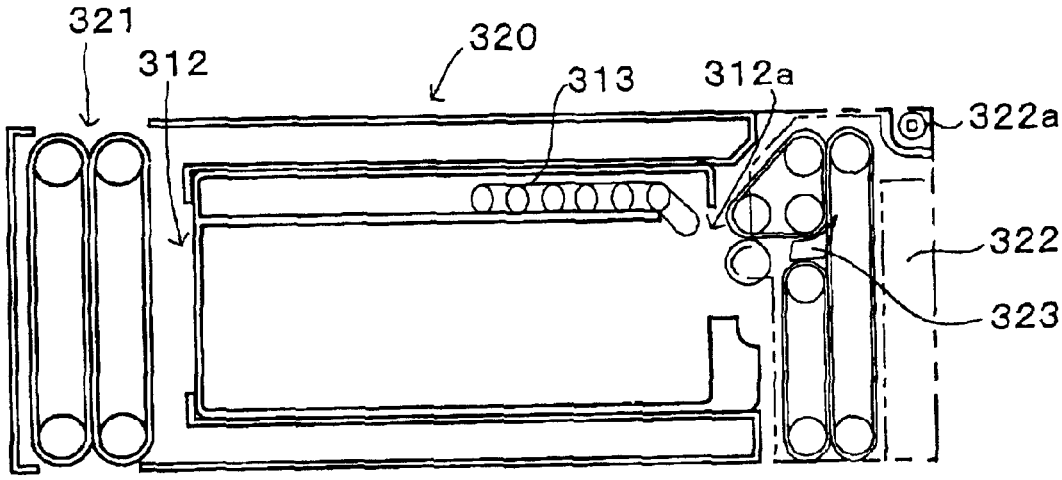
FIG. 14 is a view showing a state that the cassette shown in part (B) of FIG. 13 is being mounted on the storage-dedicated cassette mounting box shown in part (A) of FIG. 13.

FIG. 13 is a view showing (A) a storage-dedicated cassette mounting box and (B) a storage-dedicated cassette to be mounted on the storage-dedicated cassette mounting box and FIG. 14 is a view showing a state that the cassette shown in part (B) of FIG. 13 is being mounted on the storage-dedicated cassette mounting box shown in part (A) of FIG. 13.

As shown on the left of part (A) in FIG. 13, in a storage-dedicated cassette mounting box 320 in part (A) of FIG. 13, there is provided a conveyance mechanism 321 forming a part of the first conveyance path of the present invention for conveying upwards paper moneys fed from the payment-dedicated cassettes 311 shown in FIG. 12. On the right of part (A) in FIG. 13, there is provided a conveyance mechanism 322 forming a part of the second conveyance path according to the present invention for conveying the paper moneys coming from above into a cassette, mounted in the box 320 or for transmitting them to storage-dedicated cassette mounting boxes arranged further below. The conveyance mechanism 322 rotates around a hinge 322*a* as the center and is lifted upwards as shown in part (A) of FIG. 13, and then a cassette 312 shown in part (B) of FIG. 13 is mounted in the direction of an arrow shown in FIG. 13.

In the cassette 312 shown in part (B) of FIG. 13, an aperture 312*a* through which paper moneys enter is formed on the right of part (B) in FIG. 13 and a shutter 313 is provided at the aperture 312*a*.

When the cassette 312 shown in part (B) of FIG. 13 is mounted in the cassette mounting box 320 shown in part (A) of FIG. 13 and the conveyance mechanism 322 is closed, the shutter 313 is moved to the position shown in FIG. 14 by engagement members (not shown) and the aperture 312*a* of the cassette 312 is opened.

Here, a freely rotatable gate 323 is provided in the conveyance mechanism 322, and paper moneys coming from above are taken in the cassette 312 according to the position of the rotated gate 323 or conveyed further downwards.

In the embodiment in FIG. 12, among the cassette mounting boxes arranged in five levels, two boxes arranged in the lower levels are payment-dedicated cassette mounting boxes and three boxes arranged in the upper levels are storage-dedicated cassette mounting boxes. However, the number of payment-dedicated cassette mounting boxes and storage-dedicated cassette mounting boxes is not limited to the number shown in FIG. 12. Since it is necessary to provide at least one of payment-dedicated cassette mounting boxes and at least one of storage-dedicated cassette mounting boxes, a payment-dedicated cassette mounting box needs to be provided on the bottom level and a storage-dedicated cassette mounting box needs to be provided on the uppermost level. In this embodiment, cassette mounting boxes can be arranged in five levels, and any of payment-dedicated cassette mounting boxes and storage-dedicated cassette mounting boxes can be arranged on the levels except for the top and the bottom levels. However, payment-dedicated cassette mounting boxes are arranged in order from the bottom level and storage-dedicated cassette mounting boxes are arranged in order from the top level.

According to the second embodiment as described above, the ratio of a payment-dedicated part and a storage-dedicated part can be changed, and therefore, it is possible to set the most appropriate ratio according to a demand for money receipt processing and the best services for customers can be provided.

Therefore, according to the present invention as described above, increase in the cost can be suppressed to the minimum level and it is possible to satisfy demands for paper receipt processing by adapting to these demands.

What is claimed is:

1. A paper process apparatus including:

a first paper storing section for storing papers for payment, a second paper storing section, for storing papers unsuitable for payment, a temporary storing section, for accumulating papers delivered thereto, a paper delivery section that is connected to the temporary storing section for discharging in a block the accumulated papers which have been stored in the temporary storing section, a first conveyance path extending between the first paper storage section and the temporary storing section for payment one by one from the first paper storing section to the temporary storing section, whereby the papers for payment which have been conveyed from the first paper storing section are stored in the temporary storing section, and a second paper conveyance path communicating with, but diverging from, the first conveyance path, for conveying, to the second paper storing section, papers determined by discriminating means to be unsuitable for payment among the papers for payment which have been conveyed from the first paper storing section, whereby the papers unsuitable for payment which have been conveyed from the first paper storing section are stored in the second paper storing section, the paper processing apparatus comprising:

a third conveyance path suitable to receive papers from the exterior and connecting with the first conveyance path for conveying exterior papers which have been received from the exterior to the first conveyance path.

2. A paper processing apparatus according to claim 1, further comprising an exterior paper processing mechanism including a portion of said first conveyance path forming a conveyance path connected with the third conveyance path and the temporary storing section for leading the exterior papers from the third conveyance path to the temporary storing section through the first conveyance path whereby the exterior papers which have been led to the temporary storing section are accumulated in the temporary storing section and said portion of said first conveyance path communicating with said second conveyance path for leading the exterior papers which have been temporarily stored in the temporary storing section from the temporary storing section to the second paper storing section through the second conveyance path whereby the exterior papers which have been led to the second paper storing section are stored in the second paper storing section.

3. A paper processing apparatus according to claim 2, wherein the second conveyance path of the exterior paper processing mechanism extends between the first conveyance path and the second paper storing section and leads the exterior papers which have been stored in the temporary storing section from the temporary storing section to the second paper storing section through the second conveyance path whereby the exterior papers which have been led to the second paper storing section are stored in the second paper storing section, means operative to selectively return the exterior papers which have been stored in the temporary storing section from the temporary storing section to the exterior through the paper delivery section, and means operable by a user for activating the exterior paper processing mechanism to deliver exterior papers to the second storing section or to the exterior.

4. A paper processing apparatus comprising:

a paper delivery unit including a first paper storing section for storing papers for payment, a second paper storing section for storing papers unsuitable for payment, a temporary storing section for accumulating papers delivered thereto, a paper delivery section for discharging in a block the accumulated papers which have been stored in the temporary storing section, and a first conveyance path extending between the first paper storage section and the temporary storing section for conveying papers for payment one by one from the first paper storing section to the temporary storing section, whereby the papers for payment which have been conveyed from the first paper storing section are stored in the temporary storing section, a paper receipt unit arranged on the paper delivery unit for receiving exterior papers one by one from the exterior, the paper delivery unit including a third conveyance path and being operative to convey the exterior papers to the first conveyance path upon receiving the exterior papers from the paper receipt unit, and the paper unit including a fourth conveyance path communicating with the exterior through a paper receiving aperture and connecting with the third conveyance path for conveying exterior papers to the third conveyance path upon receipt of exterior papers from the exterior through the paper receiving aperture.

5. A paper processing apparatus according to claim 4, wherein the paper delivery unit further comprises an exterior paper processing mechanism including a portion of said first conveyance path forming a conveyance path connected between the third conveyance path and the temporary storing section for leading the exterior papers from the third conveyance path to the temporary storing section through the first conveyance path whereby the exterior papers which have been led to the temporary storing section are accumulated in the temporary storing section, and said portion of said first conveyance path communicating with said second conveyance path for leading the exterior papers which have been temporarily stored in the temporary storing section from the temporary storing section to the second paper storing section through the second conveyance path whereby the exterior papers which have been led to the second paper storing section are stored in the second paper storing section.

6. A paper processing apparatus according to claim 5, wherein the second conveyance path of the exterior paper processing mechanism extends between the first conveyance path and the second paper storing section and leads the exterior papers which have been stored in the temporary storing section from the temporary storing section to the second paper storing section through the second conveyance path whereby the exterior papers which have been led to the second paper storing section are stored in the second paper storing section, means operative to selectively return the exterior papers which have been stored in the temporary storing section from the temporary storing section to the exterior through the paper delivery section, and means operable by a user for activating the exterior paper processing mechanism to deliver exterior papers to the second storing sections or to the exterior.

7. A paper processing apparatus comprising:

a cassette mounting section for receiving and supporting at least one first cassette which is removable and stores therein papers for payment and at least one second cassette which is removable and stores therein store-only papers;

a paper delivery mechanism which includes a temporary storing section for accumulating papers delivered thereto, a paper delivery section connected to the temporary storing section for discharging in a block the accumulated papers which have been stored in the temporary storing section, and a first conveyance path extending between the at least one first cassette and the temporary storage section for conveying the papers for payment one by one from the at least one first cassette to the temporary storing section, whereby the papers for payment which have been conveyed from the at least one first cassette are stored in the temporary storing section;

a paper collecting mechanism which includes a second paper conveyance path communicating in divergent relation with respect to the first conveyance path and being connected to at least one of the second cassettes, the paper collecting mechanism leading to the second cassette through the second paper conveyance path being operative to convey papers unsuitable for payment among the papers for payment which have been conveyed from the first cassette;

an exterior paper processing mechanism which includes a third conveyance path suitable to receive papers from the exterior and connected to the first conveyance path for conveying exterior papers which have been received by the third conveyance path from the exterior, the first conveyance path of the exterior paper processing mechanism having a portion connecting with the temporary storing section for leading the exterior papers from the third conveyance path to the temporary storing section through the first conveyance path whereby the exterior papers which have been led to the temporary storing section are temporarily stored in the temporary storing section, said portion of said first conveyance path communicating with said second conveyance path for leading the exterior papers which have been temporarily stored in the temporary storing section from the temporary storing section to the second cassette through the second conveyance path whereby the exterior papers which have been led to the second cassette are stored in the second cassette.

8. A paper processing apparatus according to claim 7, wherein, the second conveyance path of the exterior paper processing mechanism extends between the first conveyance path and the second cassette and leads the exterior papers which have been stored in the temporary storing section from the temporary storing section to the second cassette through the second conveyance path whereby the exterior papers which have been led to the second cassette are stored in the second cassette, said second conveyance path being further alternately operative to return the exterior papers which have been stored in the temporary storing section from the temporary storing section to the exterior through the paper delivery section, and means operable by a user for selectively activating the exterior paper processing mechanism.

9. A paper processing apparatus according to claim 7, wherein the cassette mounting section contains first mounting box structure operative to support at least one first cassette mounting box for mounting a first cassette and a second mounting box structure operative to support at least one second cassette mounting box for mounting the second cassette, said cassette mounting section further including mounting box structure for mounting at least one optional cassette which is either one of the first cassette and the second cassette.

10. A paper processing apparatus comprising:

a cassette mounting section containing structure for receiving and removably supporting at least one first cassette which is operable to store therein papers for payment and at least one second cassette which is operable to store therein store-only papers;

a paper delivery unit which includes:

a paper delivery mechanism having:

a temporary storing section operable to accumulate papers delivered thereto, a paper delivery section connected to the temporary storing section for discharging in a block the accumulated papers which have been stored in the temporary storing section, and a first conveyance extending between the first cassette and the temporary storing section for conveying papers for payment one by one from the first cassette to the temporary storing section through the first conveyance path whereby the papers for payment which have been conveyed from the first cassette are stored in the temporary storing section, a paper collecting mechanism including a second paper conveyance path communicating with, but diverging from, the first conveyance path and communicating with the second cassette for leading through the second paper conveyance path papers among the papers for payment determined by discriminating means to be unsuitable for payment which have been conveyed from the first cassette, and a paper receipt unit disposed on the paper delivery unit and containing means for receiving exterior papers one by one from the exterior, wherein the paper delivery unit includes an exterior paper processing mechanism having a third conveyance path connected between the first conveyance path and the temporary storing section and operative to lead the exterior papers which have been received from the paper receipt unit by the third conveyance path to the temporary storing section through the first conveyance path whereby the exterior papers which have been led to the temporary storing section are stored in the temporary storing section, and a second conveyance path connecting with the third conveyance path for leading the exterior papers which have been temporarily stored in the temporary storing section from the temporary storing section to the second cassette whereby the exterior papers which have been led to the second cassette are stored in the second cassette, and wherein the paper receipt unit includes an exterior paper conveying mechanism having a fourth conveyance path communicating at one end with the exterior and at the other end to the third conveyance path whereby an exterior paper conveying mechanism leads exterior papers from the exterior to the third conveyance path.

11. A paper processing apparatus according to claim 10, wherein the second conveyance path of the exterior paper processing mechanism communicates with the temporary storing section to lead the exterior papers which have been stored in the temporary storing section from the temporary storing section to the second cassette whereby the exterior papers which have been led to the second cassette are stored in the second cassette means operative to selectively return the exterior papers which have been stored in the temporary storing section from the temporary storing section to the exterior through a paper delivery section, and means operable by a user for activating the exterior processing mechanism to deliver exterior papers to the second storing section or to the exterior.

12. A paper processing apparatus according to claim 10, wherein the cassette mounting section contains first mounting box structure operative to support at least one first cassette mount box for mounting a first cassette, a second mounting box structure operative to support at least one second cassette mounting box for mounting a second cassette, and including mounting box structure for at least one optional cassette which is either one of the first cassette mounting box and the second cassette mounting box.

* * * * *